US011800897B2

(12) United States Patent
Peterson

(10) Patent No.: US 11,800,897 B2
(45) Date of Patent: Oct. 31, 2023

(54) CONCENTRATE OR EXTRACT SUBLIMATION DEVICE WITH AIR-VAPOR MIXTURE MODULATION CAPABILITY

(71) Applicant: Tom Peterson, Scottsdale, AZ (US)

(72) Inventor: Tom Peterson, Scottsdale, AZ (US)

( * ) Notice: Subject to any disclaimer, the term of this patent is extended or adjusted under 35 U.S.C. 154(b) by 368 days.

(21) Appl. No.: 17/246,716

(22) Filed: May 3, 2021

(65) Prior Publication Data

US 2021/0337867 A1 Nov. 4, 2021

Related U.S. Application Data

(60) Provisional application No. 63/023,527, filed on May 12, 2020, provisional application No. 63/019,149, filed on May 1, 2020.

(51) Int. Cl.

| | |
|---|---|
| ***A24F 40/46*** | (2020.01) |
| ***A24F 40/485*** | (2020.01) |
| ***A24F 40/20*** | (2020.01) |
| ***A24F 7/04*** | (2006.01) |
| ***A24F 7/02*** | (2006.01) |
| ***B43K 24/06*** | (2006.01) |
| ***B43K 29/00*** | (2006.01) |

(52) U.S. Cl.
CPC ..... *A24F 40/46* (2020.01); *A24F 7/02* (2013.01); *A24F 7/04* (2013.01); *A24F 40/20* (2020.01); *A24F 40/485* (2020.01); *B43K 24/06* (2013.01); *B43K 29/00* (2013.01)

(58) Field of Classification Search
CPC ..... B43K 29/00
See application file for complete search history.

(56) References Cited

U.S. PATENT DOCUMENTS

| | | | | |
|---|---|---|---|---|
| 10,806,179 | B2 * | 10/2020 | Bajpai | A24F 47/00 |
| 2018/0104214 | A1 * | 4/2018 | Raichman | A61K 31/352 |
| 2018/0110943 | A1 * | 4/2018 | Raichman | A61M 15/06 |

FOREIGN PATENT DOCUMENTS

| | | | | |
|---|---|---|---|---|
| WO | WO 2016/147188 | A1 * | 9/2016 | A61M 15/00 |

* cited by examiner

*Primary Examiner* — Michael J Felton
*Assistant Examiner* — Daniel Edward Vakili
(74) *Attorney, Agent, or Firm* — Venjuris P.C.; Michael Campillo

(57) ABSTRACT

A sublimation device with an actuator body to enable modulated vapor production and including a heating bowl and a heating tip with complementary shapes.

17 Claims, 4 Drawing Sheets

CONCENTRATE OR EXTRACT SUBLIMATION DEVICE WITH AIR-VAPOR MIXTURE MODULATION CAPABILITY

FIELD OF THE INVENTION

The present invention relates to "sublimation", which comprises the method or process of inhaling a vapor produced by heating a (non-liquid) cannabis concentrate or extract with a heating element.

BACKGROUND OF THE INVENTION

"Vaping" devices have become a very popular means of inhaling cannabis (and the associated compounds) without the associated smell & smoke associated with smoking cannabis via combustion. Smoking cannabis has proven to be anything but discreet, so vaping ultimately provides a more discreet means to inhale these cannabis compounds. With that said, vaping has come under a tremendous amount of scrutiny due to the additives and/or liquids required in order to create a vapor that can be inhaled. Several vaporizer users have lost their lives and more have become ill due to the toxicity related to the additives utilized in the vape cartridges (that contain the mixture) and E-liquids (that contain the additives).

"Subbing" and "vaping" are related but require different technologies in practice. "Vaping" comprises heating a liquid concentrate or E-liquid to create a vapor and inhaling the vapor. Vaping utilizes liquid concentrates—usually packaged in a cartridge that is connectable to a heating element. Subbing on the other hand, does not require the use of a liquid concentrate or E-liquid but instead heats a cannabis concentrate or extract (which in this case, resides in a solid but pliable form) to create the vapor that is inhaled. Unfortunately, existing methods and devices utilized for both subbing and vaping of cannabis extracts can overheat the cannabis compounds, which can then become carcinogenic toxins—which can lead to lung injury upon inhalation. Finally, existing vaping and/or subbing devices do not provide for a "single serving dose" of a non-liquid cannabis concentrate or extract.

SUMMARY OF THE INVENTION

The sublimation device of the description and drawings provides a discreet and safer means of inhaling cannabis compounds and is designed specifically to utilize a cannabis concentrate/extract that does not contain any additives. The device and the concentrate are designed to work with one another wherein the concentrate utilizes an extraction process that allows it to be pliable and formable. This concentrate extraction process allows the user to load the bowl without ever having to touch the concentrate or extract. Furthermore, the concentrate or extract can be customized to contain a very specific profile of cannabis compounds—i.e., THC, Cannabinoids and Terpenes to be utilized. Since there are over 100 cannabinoids and over 120 terpenes available, the combinations of such compounds can be refined for maximum user benefit, depending on his or her individual needs.

In most general terms, the device, which will be referred to as the "vaporizer", includes a housing, an actuator body, concentrate or extract heating bowl, and a heating element with a power source. The heating element and power source are fixedly positioned in a first end of the device housing and the actuator body comprises a second end of the device housing and includes a mouthpiece and cooling element from which to draw concentrate that is sublimated within the housing. The actuator body is connectable to the heating bowl and the actuator biased against and within the housing to allow linear movement of the actuator body and bowl relative to the heating element/tip and power source, which linear relative movement of the device actuator body and heating element enables selective positioning of the heating tip in a first position that is adjacent to or at the heating element and such that the proximity of the heat sourced from the heating element is sufficient to sublimate the concentrate, and a second heating tip position such that the heat sourced from the heating element is insufficient to sublimate the concentrate.

The housing of the device may be separated to facilitate positioning of a concentrate dose at or within the heating bowl. A replaceable and interchangeable mouthpiece with a carbon filter is also provided. The filtering media utilized in this mouthpiece is efficient in filtering out the small vapor molecules that are created during sublimation—thus providing a clean and pure inhalation of the many cannabis compounds—without the typical or associated lung irritation. The filter design and filter media content will provide for efficient usage and maximum interception of very small resin particles which reside within the vapor. Finally, the variable heat settings of the device are very specific and designed to preserve the many compounds (as opposed to overheating them—which can ultimately become toxic) within the concentrate and the design of the device provides a "single use" or "single serving dose" of pure concentrate to minimize the risk of an "overdose", which can occur via other devices that do not have this feature.

BRIEF DESCRIPTIONS OF THE DRAWINGS

Figure 1A:
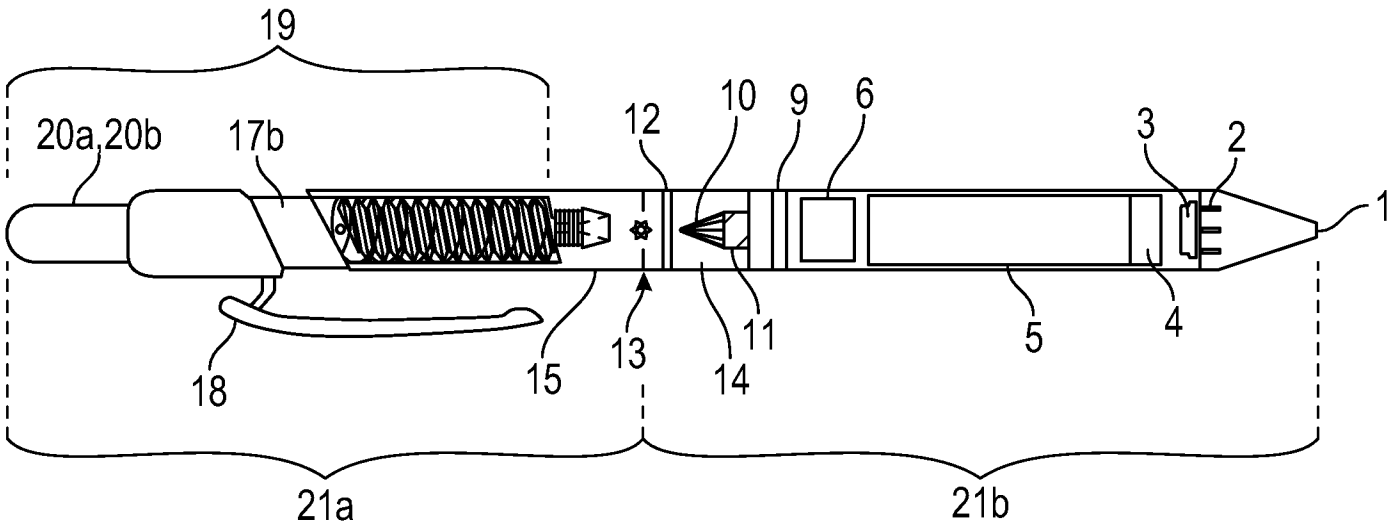
FIG. 1A is a cut-away side view of the sublimation device in accordance with an embodiment.
Figure 1C:
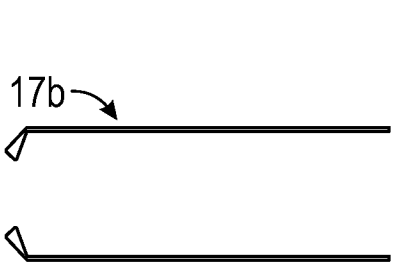
FIG. 1C is a side view of the vapor cooling jacket 17*b* in accordance with the embodiment.
Figure 1D:
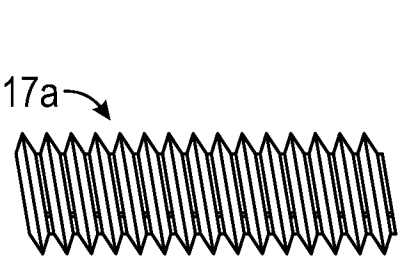
FIG. 1D is a side view of the vapor cooling element 17*a;*
Figure 1B:
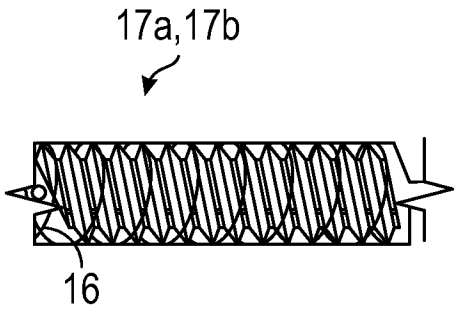
FIG. 1B is a cut-away side view of the cooling element 17*a* and cooling jacket 17*b* in accordance with the embodiment.
Figure 2A:
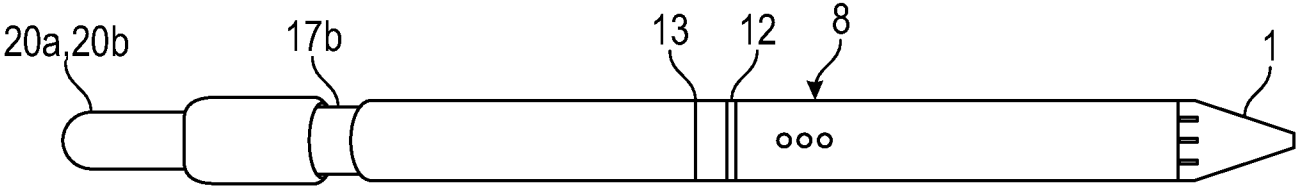
Figure 2B:
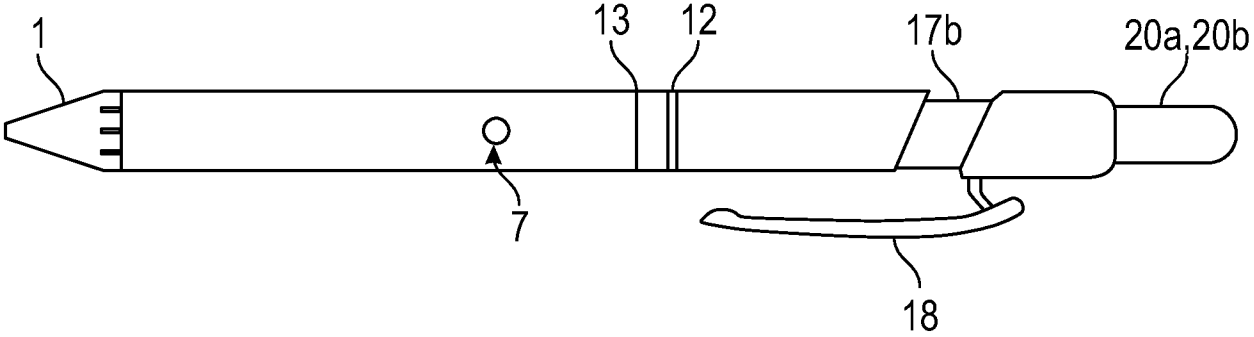
Figure 3A:
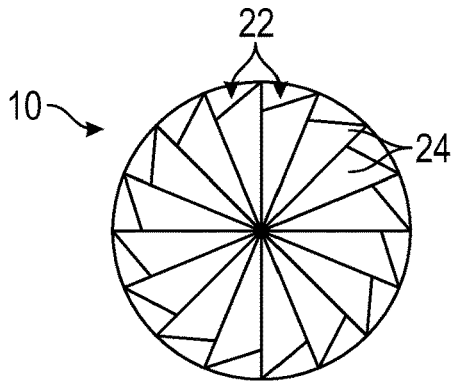
Figure 3B:
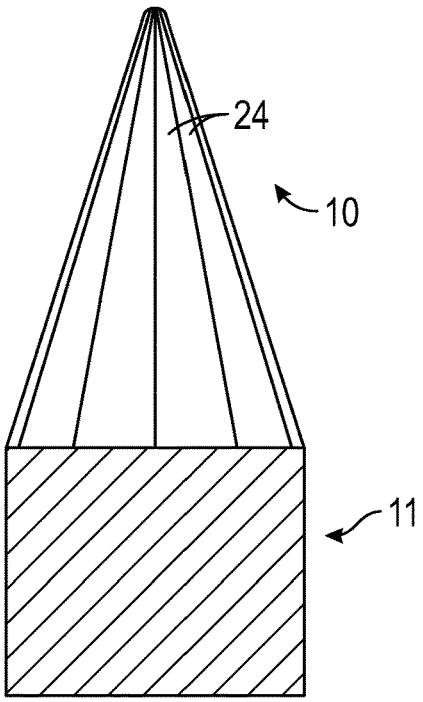
Figure 4A:
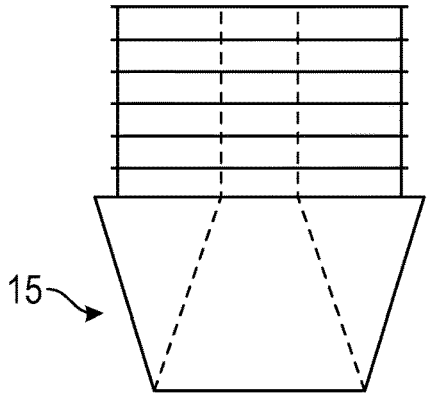
Figure 4B:
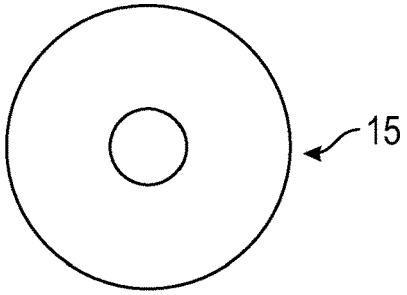
Figure 4C:
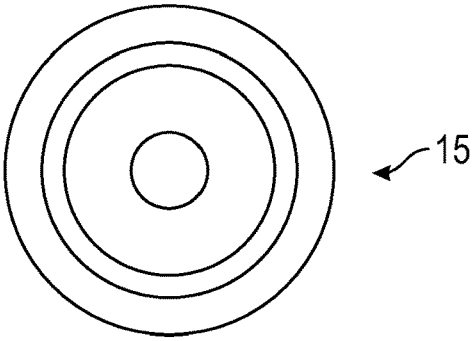
Figure 5:
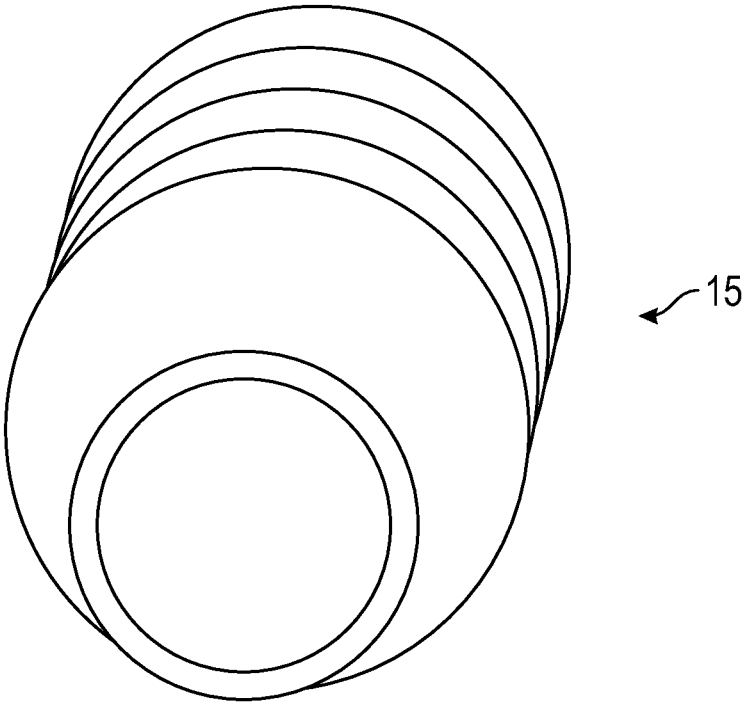

FIGS. 2A and 2B are first and second side views of the device illustrating indicator lights and a control or multi-function button to control the heating element power and temperature setting and illustrating a first and second portions of the device housing that may be disconnected or that are rotatable in accordance with the embodiment FIGS. 3A and 3B illustrate top and side views of a preferred heating tip 10 in the embodiment;

FIGS. 4A-4C illustrate side, back, and front views of a preferred heating bowl 15 in the embodiment; and FIG. 5 illustrates a perspective rear view of the heating bowl 15.

DESCRIPTION OF AN EMBODIMENT

The figures illustrate a concentrate or extracts sublimation device embodiment implementing aspects of the invention. The device may be implemented in a housing that enables independent but dual functions of a writing pen or stylus pen and a sublimation device as disclosed herein. For example, an optional adjustable and interchangeable pen tip assembly 1 and 2 allows for use as a pen for the purpose of writing or texting. Twisting the pen tip 2 clockwise may protract the ball point tip 1 for the purpose of writing and twisting the pen tip 2 counterclockwise may retract the ball point tip 1 in order to protect the ball point tip 1 when not in use. The primary function of the sublimation device, however, is to sublimate a concentrate or extract for human consumption via inhalation and includes specialized components to facilitate efficient and controlled sublimation and consumption of concentrate.

Components of a preferred sublimation device are illustrated in more detail in the figures. As illustrated in FIG. 1, the components are included within a tubular shaped housing (e.g., a writing pen as illustrated) comprised of at least two-portions, a tubular main body upper portion 21*a*, comprised of a tubular upper portion first end and a tubular upper portion second end, and a tubular main body lower portion 21*b*, further comprised of a tubular lower portion first end and a tubular lower portion second end. In the preferred embodiment, the main body upper portion 21*a* includes, in the order closest to the tubular upper portion first end, a mouthpiece 20*a* and filter 20*b* in fluid communication with a heating bowl vapor passageway that penetrates the inner cross-sectional axis of a resin heating bowl 15.

A cooling assembly may be coupled between the mouthpiece and the heating bowl 15 to cool the vapor of resin or concentrate that is sublimated within the heating bowl 15. The cooling assembly, mouthpiece 20*a* and filter 20*b*, and heating bowl 15 may comprise an actuator body 19 dimensioned and positioned for sliding movement along the longitudinal dimension of the tubular main body upper portion 21*a*. The actuator body 19 may position the heating bowl 15 against the heating tip 10 when moved in a first direction and away from the heating tip 10 if moved in an opposite second direction along the longitudinal dimension of the tubular main body upper portion 21*a*. The main body lower portion 21*b* includes the heating tip 10 and heating chamber 14, the controlled power source or battery 5, and the power and temperature control circuit board 6. The device may be disassembled by disconnecting main body upper portion 21*a* from the main body lower portion 21*b*, which provides access to, and facilitates dosing at, the bowl 15. The main body upper portion 21*a* and main body lower portion 21*b* are reconnected to use or store the device.

The actuator body 19 facilitates varied or modulated sublimation of a dose of resin or concentrate in the heating bowl 15. The actuator body 19 is enabled to extend or protract the heating bowl 15 into position near to and against the heating tip 10 sufficient to modulate or adjust for sublimation of the resin to occur and withdraw or retract the bowl 15 away from the heating tip 10 to avoid sublimation of the resin dose to occur. A return spring 16 may be included to bias the actuator body 19 for the purpose of automatically retracting the heating bowl 15 in which case the application of pressure to the actuator body 19 allows for heating and the associated sublimation of the concentrate or extract, as well as reloading the concentrate or extract for use. If included, the return spring 16 is positioned within the lower portion of the main body upper portion 21*a* and cylindrically envelopes the cooling chamber or jacket 17*b* as most clearly illustrated in FIG. 1B. A pen clip 18 may be connected to the actuator body 19 to facilitate storage of the device in a pocket and the longitudinal movement of the actuator body 19 in the tubular main body upper portion 21*a*. Sliding the actuator body 19 in the direction of the heating bowl 15 by sliding the pen clip 18 towards the tubular upper portion second end will bias or compress the return spring 16, and upon release of force or pressure on the pen clip 18, the return spring 16 will push the actuator body 19 back to its normal position, as the return spring 16 becomes decompressed or unbiased.

The mouthpiece 20*a* may comprise any structural element that enables vapor communication between the heating bowl 15 and the user's lips but a preferred mouthpiece 20*a* is illustrated in the drawings and comprises a replaceable mouthpiece 20*a* and filter 20*b*, as a one-piece, replaceable, component that is receivable and attachable to the upper main body 21*a* by pressure fit, which allows the user to disconnect the mouthpiece 20*a* and filter 20*b* from the actuator body 19 by twisting and/or pulling apart and detaching the mouthpiece 20*a* and filter 20*b* from the main body upper portion 21*a*. The mouthpiece 20*a* resides at the end of the cooling assembly within the actuator body 19, which cooling assembly is in fluid communication with concentrate heating bowl 15. To replace the mouthpiece 20*a* and filter 20*b*, the user will remove the existing mouthpiece 20*a* and filter 20*b* and insert a new mouthpiece 20*a* and filter 20*b* into the actuator body 19 and twist the mouthpiece 20*a* and filter 20*b* in a clockwise motion, thereby, locking it into place. The filter 20*b* will consist a specific filter media, designed to trap the tiny resin molecules associated with a vapor of this nature.

A preferred vapor cooling assembly may include a cooling jacket 17*b* that receives and shields a vapor heat exchanger or cooling element 17*a*. A preferred cooling assembly comprises a spiral air passageway cooling element 17*a* sheathed in a cooling jacket 17*b* (see FIGS. 1B-1D) wherein the spiral air passageway cooling element 17*a* is coupled between the mouthpiece 20*a* and heating bowl 15 and in fluid communication with the heating bowl vapor passageway. Moreover, in the illustrated embodiment, the combination of the mouthpiece 20*a*, filter 20*b*, vapor cooling assembly, and heating bowl 15 are connectable to each other to form the actuator body 19 that facilitates longitudinal movement of the actuator body 19 (and components therein) relative to the longitudinal dimension of the tubular main body upper portion 21*a*, and thereby enables the user to vary or modulate the distance of the heating bowl 15 to the heating tip 10 by longitudinal movement of the actuator body 19. The preferred cooling element 17*a* extends the vapor travel distance or time within the device by providing a non-linear route from the bowl 15 to the mouthpiece 20*a*. For example, the cooling element 17*a* may comprise a spiral or twisted heat exchange tube, with an interior length that exceeds the linear distance between the heating bowl 15 and the mouthpiece 20*a*. Finally, the preferred cooling element 17*a* is of a heat conducting material such as brass or titanium or equivalent heat conductive material. Moreover, since the cooling assembly components are at a temperature below the vapor, the vapor will be cooled as it travels through the cooling element 17*a* and cooling jacket 17*b*, prior to reaching the mouthpiece 20*a* and filter 20*b*. The preferred cooling jacket 17*b* comprises a tubular or cylindrically shaped insulating sheath that receives the cooling element 17*a* within and reduces the transfer of heat from the cooling element 17*a* to the main body upper portion 21*a* outside surface. One end of the cooling jacket 17*b* may comprise a negative edge or narrowed diameter (see FIG. 1C) to stop or prevent the cooling element 17*a* from sliding all the way through the cooling jacket 17*b*.

A preferred heating bowl 15 preferably has an inside surface with a tapered shape as illustrated by dotted lines within the heating bowl 15 in FIGS. 1 and 4A. The heating bowl 15 may have a cylindrical outside shape and a concave, cup or bowl-shaped inside surface or compartment with an opening or vapor passageway therethrough to allow for vapor to be communicated through one end to the other. See FIGS. 4A-4B. The heating bowl 15 may be accessed by separation of the main body upper portion 21*a* from the main body lower portion 21*b* and is preferably positioned just adjacent and inward from the separation point between the main body upper portion 21*a* and the main body lower portion 21*b* and such that the depression of the actuator body 19 moves the heating bowl 15 beyond the separation point 13 and against or close enough to the heating tip 10 to sublimate the dose of resin in the heating bowl 15. Finally, the mouthpiece 20*a* and filter 20*b* may resemble a writing pen button-end and be depressed and retracted as is normal for a pen end; but instead of actuating a ball-point end, depression and retraction of the mouthpiece 20*a* and filter 20*b* may move the actuator body 19 longitudinally relative to the main body lower portion 21*b* to actuate the heating bowl 15 toward or away from the heating tip 10.

The heating tip 10 is coupled to the heating element 11 and both are positioned within a heating chamber 14 that is positioned at second end of the main body lower portion 21*b* and adjacent the separation point 13. A carb ring 12 is circumferentially and rotatably coupled to the main body lower portion 21*b* to allow for adjustment of clean air intake during the sublimation and associated inhalation process. The carb ring 12 has at least one vent or hole and is used by spinning the carb ring 12 to align the holes in the carb ring 12 with corresponding holes in the wall of the heating chamber 14. This adjustability provides the user with multiple clean air intake settings and allows the user to adjust the preferred amount of clean air intake via the "serving size" of the extract or concentrate, as well as individual user preference—related to the combination or ratio of clean air and vapor being inhaled simultaneously. A ceramic insulator 9 reduces the conduction of heat from the heating element 10 to the circuit board 6 and battery 5 and also serves as a heat dissipation modulator. The heating element 11 provides the appropriate temperature for the heating tip 10 based on the temperature setting selected by the user. Upon pressing the multi-functional button 7 for the appropriate temperature setting (levels 1-5), the circuit board 6 will send the specific voltage to the heating element 11 in order to achieve the specific temperature range chosen. Each temperature level is specific to the combination of cannabinoid and terpene compounds within a specific concentrate or extract. The five temperature levels provide a specific temperature range for each and every combination of cannabinoid concentrates and/or extracts. These combinations will contain compounds with varied but specific flash points that fall within the five individual temperature ranges.

The heating tip 10 is designed to heat the concentrate both directly and indirectly, depending on the positioning of the heating bowl 15 relative to the heating tip 11. Sliding the pen clip 18 towards the tubular upper portion second end moves the actuator body 19 and heating bowl 15 towards the heating tip 10. At some point, the heating bowl 15 comes close enough to the heating tip 10 and the dose of resin or concentrate within the heating bowl 15 begins to heat and eventually vaporize via sublimation/convection. The user may stop when initial sublimation occurs or move the dosing bowl 15 even closer to the heating tip 10 for greater or faster sublimation of the dose of resin or concentrate. At a point where the heating bowl 15 contacts or just about contacts the heating tip 10, the heating tip 10 will penetrate and directly heat the dose of resin or concentrate via sublimation/convection. This controlled sublimation method—provided by indirect and direct application of heat provides for a very efficient use of the concentrate, as there is little to no remaining residue left behind—which also minimizes the amount of cleaning required in order to maintain the device.

A preferred heating tip 10 has a surface shape that is a complementary shape to the heating bowl 15 inside shape. For example, the heating bowl 15 inside shape may be a concave shape with a wider rim and a tapered end wherein the heating bowl vapor passageway is positioned at the tapered end, and the heating tip 10 may comprise a complementary (i.e. opposite matching) convex shape dimensioned and curved or angled to complement the heating bowl inside concave shape such that when the heating bowl 15 and the heating tip 10 are brought together the respective surfaces of the heating bowl 15 and the heating tip 10 make flush contact. The distal tapered end of the heating tip 10 may extend completely through the heating bowl 15 and just into the heating bowl vapor passageway at flush contact of the respective surfaces of the heating bowl 15 and the heating tip 10. Additionally, a preferred heating tip 10 may have at least one, but preferably a plurality of flutes, channels, or airways that extend the length of the convex surface of the heating tip 10. As an example, FIGS. 3A-3B illustrate a heating tip 10 with a plurality of channels 22 formed by a plurality of edges 24 oriented along, and that extend radially from, the tapered length of the heating tip 10. In the preferred embodiment, the edges 24 are angled triangles that extend radially from the heating tip 10 so that flutes or channels are located between adjacent angled triangles and the angled triangles can act as scrappers to clean the heating bowl 15 as the actuator body 19 is compressed, to contact the heating bowl 15 against the heating tip 10, and rotated relative to the tubular main body lower portion 21*b* and heating tip 10 attached thereto, to scrape the dosing bowl inside surface with the heating tip edges 24. The device allows the user to rotate the main body upper portion 21*a* (either clockwise or counterclockwise) during use, which provides for a "self-cleaning" mechanism of both the heating tip 10 and heating bowl 15. This self-cleaning mechanism minimizes the amount of time and energy spent cleaning the device. It also allows the device to perform with very consistent results by greatly reducing the amount of residue and/or remaining resin that would typically be left behind in the incinerator of a typical smoking or vaping device.

The preferred heating tip 10 has a conical shaped end with a plurality of channels or flutes oriented along the heating tip 10 to allow fresh air to pass by the heating tip 10 and through the opening in the bottom of the heating bowl 15 during sublimation/inhalation. Since the heating tip 10 and heating bowl 15 are a mated pair with complementary shapes, the air channels allow fresh air to pass by the heating tip 10 and through the bottom of heating bowl 15 into the heating bowl vapor passageway when the heating tip 10 has fully penetrated the heating bowl 15 and the respective surfaces are in contact. This design of the heating tip 10 allows for vapor to also be inhaled through the bottom of the heating bowl 15 despite that the heating tip 10 is fully inserted (via the user) into the heating bowl 15 and into contact with the extract or concentrate. The device design also allows for the use of an interchangeable heating element 11 tips and heating bowls 15. This design allows the user to select the size and shape of heating tip 10 and heating bowl 15 that suits his or her needs the best or that is optimal for the concentrate or extract. The heating tips 10 and bowls 15 may come in multiple sizes that will ultimately produce a greater or lesser amount of vapor during the time in which the concentrate or extract is being heated by the heating element/tip.

The main body lower portion 21*b* positions the interchangeable heating tip or element 11 at one end of the second housing portion just adjacent and inward from the separation point 13 between the main body upper portion 21*a* and the main body lower portion 21*b*. The heating element 11 is coupled to a functionally connected and controllable power source, such as a lithium-ion battery 5. A mini-USB or other style of charging port 3 resides at the base of the device above the pen tip assembly 2. The battery management system 4 is designed to modulate the charging, discharging and temperature of the battery 5 in order to reduce the risk of overheating the rechargeable Lithium ion or Lithium ion battery 5. The battery management system 4 assists in achieving maximum system efficiency—which impacts both battery discharge rate and battery life. The battery management system 4 will also notify the user when the battery level is low via the indicator lights 8. The battery management system 4 is implemented software running on a controller on the circuit board 6 that will also capture inputs from the user via a single, multi-functional button 7. The multi-functional button 7 provides multiple functions for the user such as: On/Off, Start/Heat, Temperature Setting, Temperature Verification and Battery Charge Status. The circuit board 6 will also provide the user with status of all functions via the indicator lights 8. These indicator lights 8 also provides the user with Temperature setting confirmation, as well as Current temperature (setting) verification. This allows the user to visually see that the appropriate and specified temperature setting has been achieved prior to use.

The separation point 13 of the device allows the user to disconnect the main body upper portion 21*a* and main body lower portion 21*b* by twisting one relative to the other and disconnecting it from the main body lower portion 21*b*. The user then has access to the heating chamber 14 and heating bowl 15, which allows for reloading of the concentrate into the heating bowl 15. In order to reload the concentrate into the heating bowl 15, the user may press the actuator body 19 via the pen clip 18, which extends the heating bowl 15 past the separation point 13 to allow for reloading. This is a safety feature minimizes the likelihood of a user being burned accidentally by a heating bowl 15 that may still be hot. The heating bowl 15, as well as the pliable concentrate or extract are designed to provide a more efficient reloading of the concentrate and/or extract—by allowing the user to reload without touching either the concentrate/extract or the heating bowl 15 during the process. This design provides for additional convenience and safety—over and above the typical "dry herb" or "wax" vaporizers that exist today. The separation point 13 also allows for thorough cleaning of the heating chamber 14, as well as the heating element 11, once the main body upper portion 21*a* and main body lower portion 21*b* are separated. This is performed by simply rotating the main body upper portion 21*a* relative to the main body lower portion 21*b* and disconnecting the two.

The device design as described above allows the user to adjust or modulate the ratio of fresh air intake vs. vapor intake during the time in which the fresh air/vapor mixture is being inhaled. Once the carb ring 12 is set to an initial maximum allowable fresh air intake level, the user may reverse the actuator body 19 away from the main body lower portion 21*b* during inhalation to induce a larger ratio of fresh air to vapor or move the actuator body 19 forward during inhalation to provide a greater ratio of vapor to fresh air via modulation. This functionality allows the user to customize the ratio of fresh air to vapor during use, which can be very beneficial to the user for many reasons. When inhaling a fresh air/vapor mixture, the lungs allow the user to "feel" the ratio of vapor vs. fresh air being inhaled. This allows the user to utilize their lungs as a gauge/monitor and add more fresh air if the lungs "feel" too much vapor at any given time. The opposite approach can be applied if the user doesn't feel enough vapor in the lungs during inhalation. The device is designed to be simple to carry, simple to use, and safer than other vaping and/or smoking devices that are on the market today. The cannabis industry is still very rudimentary in many ways, so the evolution of products such as this allows more users and more patients to live better and longer via the many benefits that this technology will provide for them.

While various embodiments have been described above, it should be understood that the embodiments have been presented by way of example only, and not limitation. Thus, the breadth and scope of a preferred embodiment should not be limited by any of the above-described exemplary embodiments but should be defined only in accordance with the following claims and their equivalents.

The invention claimed is:

1. A sublimation device, comprising:

a tubular main body upper portion including a heating bowl in fluid communication with a mouthpiece, the heating bowl dimensioned and shaped to move longitudinally within and along the inside of the tubular main body upper portion, the heating bowl with a heating bowl inside shape and a heating bowl vapor passageway therethrough for fluid communication between the heating bowl and the mouthpiece, the mouthpiece located outside of a first end of the tubular main body upper portion, the heating bowl positionable variably adjacent at a second end of the tubular main body upper portion due to the heating bowl dimension and shape and longitudinal movement within and along the inside of the tubular main body upper portion; and a tubular main body lower portion having a first end and a second end, the second end sized and dimensioned to removably couple to the second end of the tubular main body upper portion, the tubular main body lower portion including a heating tip functionally coupled to a power source, the heating tip having a complementary shape to the heating bowl inside shape;

wherein the tubular main body upper portion and the tubular main body lower portion may be separated to load a dose into the heating bowl and the tubular main body upper portion and the tubular main body lower portion may be connected together, and the heating tip may be heated by the power source, and the heating bowl moved longitudinally within and along the tubular main body upper portion and into varied proximity with the heating tip.

2. The sublimation device in claim 1 wherein, the heating bowl inside shape is a concave shape with a tapered end, the heating bowl vapor passageway is positioned at the tapered end, and the tapered end is positionable over the heating tip until the heating tip extends past the tapered end and into the heating bowl vapor passageway.

3. The sublimation device in claim 1 wherein, the heating bowl inside shape is a concave shape with a rim and a tapered end and the rim is oriented towards the second end of the tubular main body upper portion.

4. The sublimation device in claim 3 wherein, the heating tip complementary shape is a convex shape with at least one surface air channel that extends from the heating tip rim to the tapered end.

5. The sublimation device in claim 4 wherein, the at least one heating tip surface channel comprises a plurality of heating tip surface channels that extend from a heating tip base to the tapered end.

6. The sublimation device in claim 3 wherein, the concave shape is a concave conical shape.

7. The sublimation device in claim 1 wherein, the tubular main body upper portion further includes a spiral vapor passageway cooling element coupled between the heating bowl vapor passageway and the mouthpiece.

8. The sublimation device in claim 7 wherein, the spiral vapor passageway cooling element is cylindrically shaped.

9. The sublimation device in claim 7 wherein, the tubular main body upper portion further includes a cooling element jacket into which the spiral vapor passageway cooling element is received within the tubular main body upper portion.

10. The sublimation device in claim 1 further comprising, a carburetor comprised of a ring encircling an at least one air passage in the tubular main body lower portion.

11. A sublimation device, comprising:

a tubular upper portion removably connectable to a tubular lower portion, the tubular upper portion having a longitudinal dimension and an upper portion first end and an upper portion second end, the tubular lower portion having a tubular lower portion first end and tubular lower portion second end;

a mouthpiece with a vapor passage;

a concave heating bowl having a bowl inside surface, a tapered end, and a rim, the tapered end oriented towards the mouthpiece and including a bowl aperture in fluid communication with the vapor passage, the concave heating bowl dimensioned for movement along the longitudinal dimension; and a heating tip electrically coupled to a controlled power source, the heating tip positioned in the tubular lower portion at the tubular lower portion first end, the heating tip with a convex complementary shape relative to the concave heating bowl;

wherein the concave heating bowl inside surface is positioned against the heating tip convex complementary shape by movement along the longitudinal dimension and positioned away from the heating tip convex complementary shape by opposite movement along the longitudinal dimension.

12. The sublimation device in claim 11 wherein, the concave heating bowl has a shape selected from a curved concave shape and a linear concave shape.

13. The sublimation device in claim 11 further comprising, a spiral vapor cooling element within a sleeve-like cooling element is coupled between the mouthpiece and the concave heating bowl, the spiral vapor cooling element in fluid communication with the vapor passage, and the sleeve-like cooling element is dimensioned for sliding movement along the longitudinal dimension.

14. The sublimation device in claim 13 wherein, the cooling element jacket is dimensioned for rotational movement around the longitudinal dimension.

15. The sublimation device in claim 11 wherein, the heating tip with a convex complementary shape that has at least one air channel that extends from a heating tip rim to a heating tip tapered end.

16. The sublimation device in claim 15 wherein, the bowl aperture is at the tapered end and the at least one air channel penetrates the bowl aperture when the concave heating bowl inside surface is positioned against the heating tip convex complementary shape.

17. The sublimation device in claim 11 wherein, a spiral vapor cooling element is coupled between the mouthpiece and the concave heating bowl and shares the vapor passage, and the concave heating bowl and spiral vapor cooling element are dimensioned for movement along the longitudinal dimension.

* * * * *